US005988474A

United States Patent [19]

Smith, II et al.

[11] Patent Number: 5,988,474

[45] Date of Patent: Nov. 23, 1999

[54] MULTI-FUNCTIONAL CARRYING DEVICE

[76] Inventors: David R. Smith, II, 838 Judson Ave. # 3B, Evanston, Ill. 60202; Matthew Thomas J. Holcomb, 1725 Orrington Ave. #110-1; James Anthony Jeff, Jr., 1725 Orrington Ave. #610-1, both of Evanston, Ill. 60201

[21] Appl. No.: 09/062,105

[22] Filed: Apr. 17, 1998

[51] Int. Cl.[6] ..... A45F 4/02

[52] U.S. Cl. ..... 224/578; 224/153; 224/603; 224/627; 224/656; 224/257; 224/620

[58] Field of Search ..... 224/577, 578, 224/579, 580, 581, 153, 600, 602, 603, 606, 614, 616, 620, 627, 637, 642, 643, 257, 258, 660, 662, 663, 664, 901, 901.4, 654, 656

[56] References Cited

U.S. PATENT DOCUMENTS

| | | | |
|---|---|---|---|
| 3,019,952 | 2/1962 | Brewster | 224/579 X |
| 4,018,369 | 4/1977 | Jaeger . | |
| 4,125,212 | 11/1978 | Courchesne | 224/578 X |
| 4,515,300 | 5/1985 | Cohen . | |
| 4,518,107 | 5/1985 | Amos | 224/901.4 X |
| 4,867,359 | 9/1989 | Donovan . | |
| 4,932,574 | 6/1990 | Doshi | 224/579 X |
| 5,172,838 | 12/1992 | Rowell et al. | 224/664 X |
| 5,344,056 | 9/1994 | Challoner et al. . | |
| 5,425,485 | 6/1995 | Carlo . | |
| 5,437,401 | 8/1995 | Seltzer . | |
| 5,450,991 | 9/1995 | Neading . | |
| 5,490,619 | 2/1996 | Boyar . | |
| 5,509,589 | 4/1996 | Kliot . | |
| 5,513,787 | 5/1996 | Reed . | |
| 5,540,364 | 7/1996 | Krieger et al. . | |
| 5,642,842 | 7/1997 | Taras . | |
| 5,797,529 | 8/1998 | Lavine | 224/581 X |

*Primary Examiner*—Gregory M. Vidovich
*Attorney, Agent, or Firm*—Welsh & Katz, Ltd.

[57] ABSTRACT

A multi-functional carrying device, including a strap with two ends which can be secured into loops, and a bag secured to the middle section of the strap. The bag is provided with a receiving element near its upper portion, which receiving element is capable of receiving the two ends of the strap, which strap then serves as shoulder straps for carrying the bag. A securing element is provided so that the bag can be compressed and secured along the middle section of the strap when the bag is not needed.

18 Claims, 3 Drawing Sheets

MULTI-FUNCTIONAL CARRYING DEVICE

The present invention relates to a multi-functional carrying device, and more specifically, to a single device which can be used as a carrying strap but can easily be converted into a backpack.

BACKGROUND OF THE INVENTION

Many athletic activities require the use of bulky equipment which must be carried from place to place. Often, when a person puts on the equipment, personal belongings must be removed and conveniently stored.

For example, in-line skating is an extremely popular activity. Generally, the skates are carried to a location where the skating is to take place. Before the skates can be worn, the person's shoes must, of course, be removed. Since facilities to store the person's shoes and other personal belongings are seldom available or convenient, the skater usually carries his shoes and other personal belongings with him as he skates. Because skating requires a full range of motion, it is desirable to minimize restrictions to the skater's mobility, including the bulkiness of any carrying or storage device. The same problems are encountered with other activities, such as skiing, roller skating, ice skating, or any other activity which involves the carrying of bulky equipment.

Therefore, there is a need for a convenient carrying and storage device which can be used to transport bulky equipment, and which can be used to conveniently store and carry personal belongings while the person engages in an athletic activity.

SUMMARY OF THE INVENTION

Accordingly, an object of the present invention is to provide a device for transporting bulky equipment.

Another object of the present invention is to provide a device for conveniently storing and carrying personal belongings.

A further object of the present invention is to provide a device which is sufficiently small in size and bulk to reduce restrictions in the user's mobility.

In accordance with the present invention, all of these objects, as well as other not herein specifically identified, are achieved generally by the present multi-functional carrying device in which a single device can be used to carry bulky equipment and then easily converted into a backpack to store and carry personal belongings.

More specifically, the present invention includes a strap with two ends which can be secured into loops. A bag, having an upper and lower portion, is attached to the middle section of the strap near its bottom portion. The bag is provided with a receiving element near its upper portion, which receiving element is capable of receiving the two ends of the strap, allowing the strap to serve as shoulder straps for the bag. Further, a securing element is provided so that the bag can be compressed and secured along the middle section of the strap when the bag is not needed.

BRIEF DESCRIPTION OF THE DRAWINGS

Further objects of the invention, taken together with additional features contributing thereto and advantages occurring therefrom, will be apparent from the following description of the invention when read in conjunction with the accompanying drawings, wherein.

DETAILED DESCRIPTION OF THE INVENTION

Figure 1:
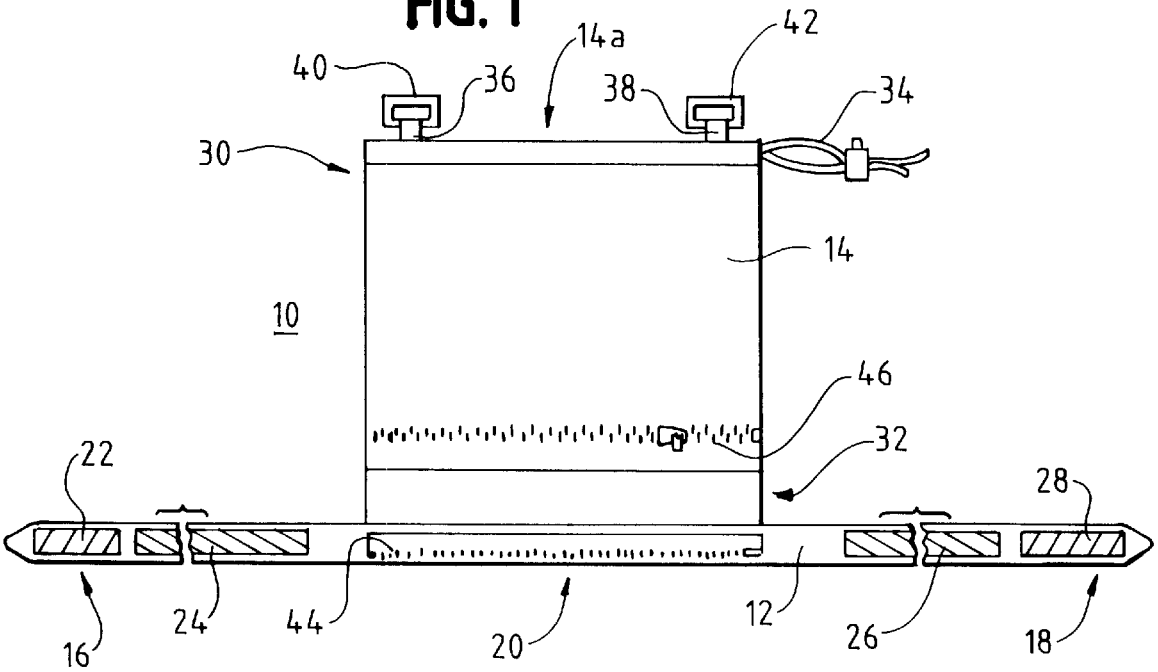
FIG. 1 is planar view of one embodiment of the present invention.

FIG. 1 shows an embodiment of the present multi-functional carrying device, generally designated as 10. The carrying device includes a strap 12 and a bag 14. The strap 12 has two ends 16, 18, and a middle section 20. Each of the two ends 16, 18 is provided with a set of engaging Velcro (hook and loop fasteners) fasteners 22 and 24, and 26 and 28. Accordingly, the ends 16, 18 of the strap 12 can be folded over to secure loops at the ends 16, 18 of the strap 12. Although Velcro fasteners are shown, other types of fastening devices and methods can be used to form the loops, including but not limited to, buckles or snaps, without departing from the scope of the present invention.

The bag 14 has an upper portion 30 and a lower portion 32. The lower portion 30 of the bag 14 is attached to the middle section 20 of the strap 12. The upper portion 30 is open for receiving items into the bag 14. A drawstring 34 may be provided at the upper portion 30 of the bag 14 to secure the contents of the bag 14. The upper portion 30 of the bag 14 is further provided with a structure to receive the ends 16, 18 of the strap 12. In FIG. 1, the structure is shown as a pair of buckles 40, 42 secured to the upper portion 30 of the bag 14 by straps 36 and 38.

Figure 2:
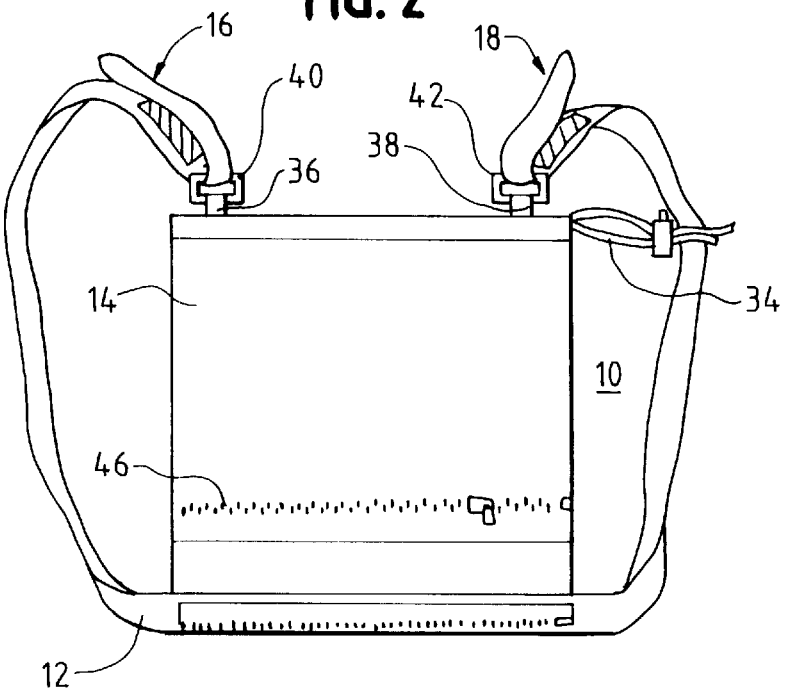
FIG. 2 is a perspective view of the embodiment shown in FIG. 1 in which the present invention has been converted to a backpack.

As shown in FIG. 2, the ends 16, 18 of the strap 12 can be inserted through the buckles 36, 38 and then secured thereto by engaging the Velcro fasteners 22 and 24, and 26 and 28. In this manner, the strap 12 serves as a pair of shoulder straps, and the device 10 can be used as a backpack. The length of the shoulder straps may be adjusted to best fit the user by varying the amount of the strap 12 which is folded over after the ends 16, 18 of the strap 12 are inserted through the buckles 40, 42.

Referring back to FIG. 1, a first and second set of engaging zipper teeth 44 and 46 may be provided to secure the bag 14 along the middle section 20 of the strap 12 when the bag 14 is not needed. The first set of zipper teeth 44 is attached along the middle section 20 of the strap 12, with the teeth oriented in the downward direction. The second set of teeth 46 is attached near the lower portion 32 of the bag 14. The second set of teeth 46 is generally parallel to and spaced apart from the first set of teeth 44. The teeth of the second set of teeth 46 are oriented in the upward direction.

Figure 3:
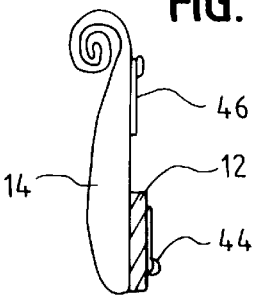
FIG. 3 is sectional view of the middle section of the strap and bag as the bag is being rolled-up and compressed.
Figure 4:
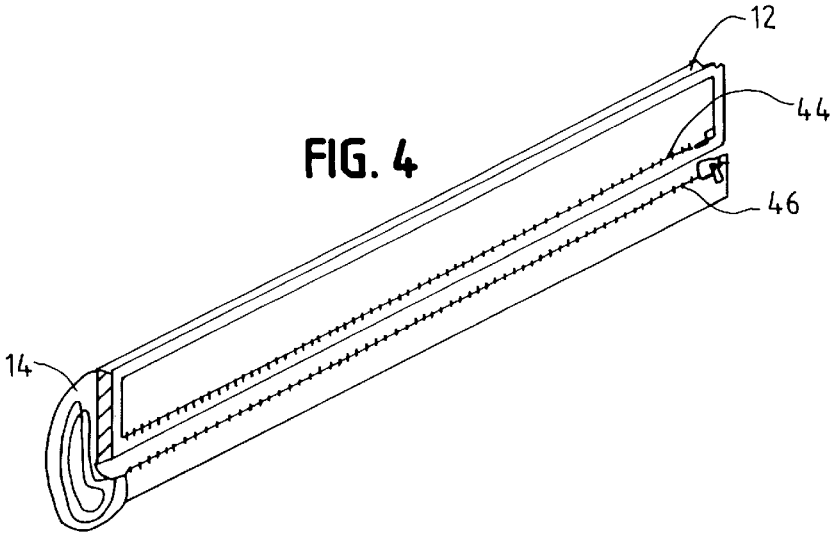
FIG. 4 is a perspective section view of the middle section of the strap wherein the bag has been compressed and is ready for securing.

Accordingly, the bag 14 may be rolled-up as shown in FIG. 3, until the second set of teeth 46 is wrapped around the middle section 20 of the strap 12, as shown in FIG. 4. The first and second set of teeth 44, 46 are thereby ready for engagement.

Figure 5:
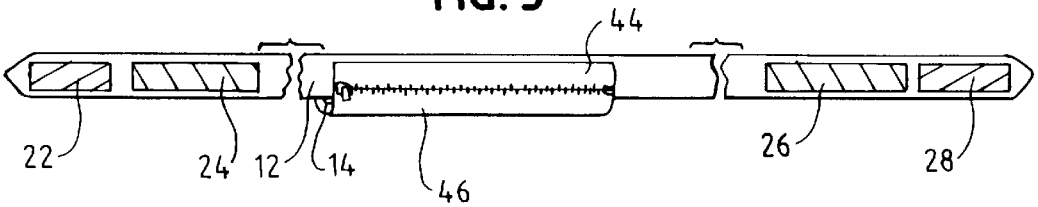
FIG. 5 is a planar view of an embodiment of the present invention in which the bag is compressed and secured.
Figure 6:
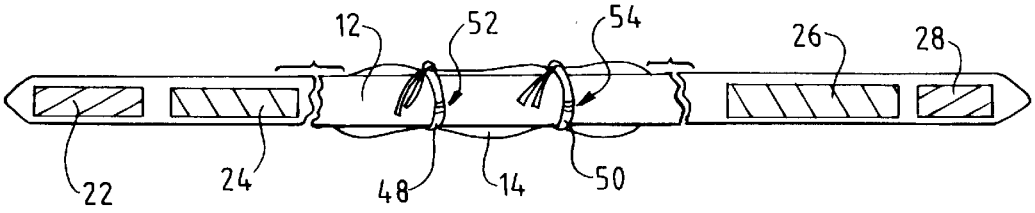
FIG. 6 is a planar view of another embodiment of the present invention in which the bag is compressed and secured.

FIG. 5 shows an embodiment of the present carrying device 10 with the bag 14 fully compressed and secured along the middle section 20 of the strap 12. It is, of course, not necessary that zippers be used to secure the compressed bag 14 along the middle section 20 of the strap 12. Other methods and configurations may also serve equally well. FIG. 6, for instance, depicts tying straps 48, 50 which may be secured to the middle section 20 of the strap 12, shown as points 52 and 54, to tie the rolled-up bag 14 in place.

Figure 7:
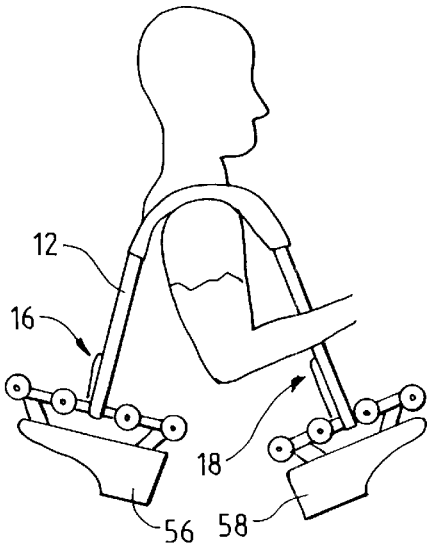
FIG. 7 shows an embodiment of the present invention being used to carry in-line skates.
Figure 8:
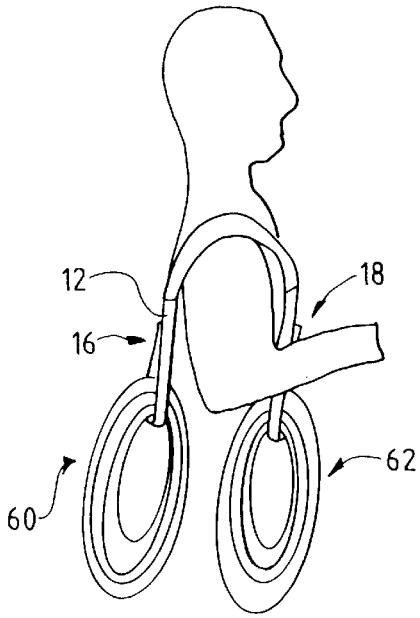
FIG. 8 shows an embodiment of the present invention being used to carry ropes.
Figure 9:
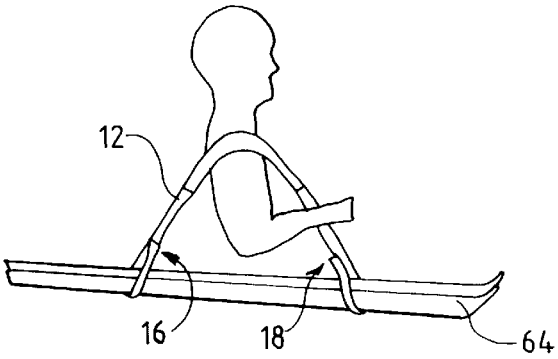
FIG. 9 shows an embodiment of the present invention being used to carry snow skis.
Figure 10:
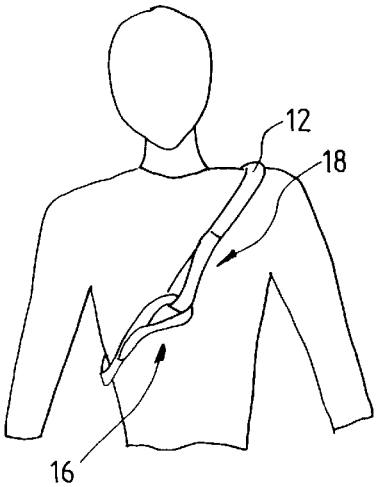
FIG. 10 shows an embodiment of the present invention being carried by the user.

When the carrying device 10 is in the configuration shown in FIGS. 5 or 6, it may be used to carry bulky items. For instance, FIG. 7 shows the present carrying device 10 being used to carry in-line skates 56, 58. The ends 16, 18 of the strap 12 are inserted through the in-line skates 56, 58 and secured into a loop. The strap 12 may then be slung over a shoulder to conveniently carry the items. Similarly, the present carrying device can be used to carry other items, such as ropes 60, 62 as shown in FIG. 8, or skis 64 as shown in FIG. 9. When the carrying device 10 is used to carry large or heavy items, the rolled-up bag 14, which falls on the shoulders of the user, provides a compressible support to enhance comfort. Additionally, when the carrying device 10 is not needed at all, the ends 16, 18 of the strap may be looped together and secured as shown in FIG. 10 to conveniently carry the device 10 without inhibiting mobility.

While particular embodiments of the present invention have been shown and described, it will be appreciated by those skilled in the art that changes and modifications may be made thereto without departing from the invention in its broader aspects and as set forth in the following claims.

What is claimed is:

1. A carrying device comprising, in combination:

a strap having a first and second end and a middle section, said first and second ends each provided with a fastener;

a bag having a closed lower portion and upstanding peripheral sidewalls leading therefrom to an opening at an upper portion, said bag being attached to said middle section of said strap;

at least one receiving element provided at said upper portion of said bag, said at least one receiving element for selectively receiving said first and second ends of said strap so as to form a pair of carrying straps; and a securing means attached to said middle section of said strap wherein said upper portion of said bag selectively being manipulated toward said lower portion of said bag in a compressed configuration and said securing means securing said bag in the compressed configuration.

2. The carrying device as described in claim 1 wherein each of said fasteners are engaging hook and loop portions which are selectively engaged to form a loop.

3. The carrying device as described in claim 1 wherein said at least one receiving element is a buckle through which said first and second ends are selectively inserted and secured.

4. The carrying device as described in claim 1 further provided with a drawstring at said upper portion of said bag.

5. The carrying device as described in claim 1 wherein said securing means is a zipper having a first and second set of teeth, said first set of teeth attached to said middle section of the strap, said second set of teeth attached to said bag, said second set of teeth spaced apart from and parallel to said first set of teeth, wherein said first and second set of teeth are engaged to secure said bag when said bag is in the compressed configuration.

6. The carrying device as described in claim 1 wherein said securing means is at least one tying strap attached to said middle section of said strap to tie said bag in place when said bag is in the compressed configuration.

7. A carrying device comprising, in combination:

a strap having a first and second end and a middle section, said first and second ends each provided with fastening means for securing a loop at said first and second ends;

a bag having a closed bottom portion and upstanding peripheral sidewalls leading therefrom to an opening at a top portion, said bag being attached to said middle section of said strap;

receiving means attached to said top portion of said bag for selectively receiving said first and second ends of said strap so as to form a pair of carrying straps; and securing means attached to said middle section of said strap wherein said upper portion of said bag is selectively manipulated toward said lower portion of said bag in a compressed configuration and said securing means securing said bag in the compressed configuration.

8. The carrying device as described in claim 7 wherein said securing means is a zipper having a first and second set of teeth, said first set of teeth attached to said middle section of the strap, said second set of teeth attached to said bag, said second set of teeth spaced apart from and parallel to said first set of teeth, wherein said first and second set of teeth are engaged to secure said bag when said bag is in the compressed configuration.

9. The carrying device as described in claim 7 wherein said securing means is at least one tying strap attached to said middle section of said strap to tie said bag in place when said bag is in the compressed configuration.

10. The carrying device as described in claim 7 wherein each said fastening means is a set of engaging hook and loop portions.

11. The carrying device as described in claim 7 wherein said receiving means is a first and second buckle through which said first and second ends are selectively inserted and secured.

12. The carrying device as described in claim 7 further comprising closure means for closing said bag.

13. The carrying device as described in claim 12 wherein said closure means is a drawstring located along said upper portion of said bag.

14. A carrying device comprising, in combination:

a strap having a first and second end and a middle section, said first and second ends each provided with a fastener for securing a loop at each of said first and second ends;

a bag having a closed lower portion and upstanding peripheral sidewalls leading therefrom to an opening at an upper portion, said lower portion of said bag being attached to said middle section of said strap so as to form a pair of carrying straps;

a first and second receiving element attached to said upper portion of said bag for selectively receiving said first and second ends of said strap; and securing means attached to said middle section of said strap wherein said upper portion of said bag is selectively manipulated toward said lower portion of said bag in a compressed configuration and said securing means securing said bag in the compressed configuration.

15. The carrying device as described in claim 14 wherein each of said fasteners are engaging hook and loop portions.

16. The carrying device as described in claim 14 wherein said first and second receiving elements are buckles through which said first and second ends are selectively inserted and secured.

17. The carrying device as described in claim 14 wherein said securing means is a zipper having a first and second set of teeth, said first set of teeth attached to said middle section of the strap, said second set of teeth attached to said bag, said second set of teeth spaced apart from and parallel to said first set of teeth, wherein said first and second set of teeth are engaged to enclose and secure said bag in the compressed configuration.

18. The carrying device as described in claim 14 further comprising a drawstring located along said upper portion of said bag.

* * * * *